US011202955B1

(12) United States Patent
Sims

(10) Patent No.: US 11,202,955 B1
(45) Date of Patent: Dec. 21, 2021

(54) SHORT-STOP BASEBALL MITT AND ASSOCIATED USE THEREOF

(71) Applicant: Ronnie Sims, Bronx, NY (US)

(72) Inventor: Ronnie Sims, Bronx, NY (US)

( * ) Notice: Subject to any disclaimer, the term of this patent is extended or adjusted under 35 U.S.C. 154(b) by 0 days.

(21) Appl. No.: 17/112,387

(22) Filed: Dec. 4, 2020

Related U.S. Application Data

(63) Continuation-in-part of application No. 15/394,717, filed on Dec. 29, 2016, now abandoned.

(60) Provisional application No. 62/272,640, filed on Dec. 29, 2015.

(51) Int. Cl.
*A63B 71/14* (2006.01)
*A63B 102/18* (2015.01)

(52) U.S. Cl.
CPC ..... *A63B 71/143* (2013.01); *A63B 2102/18* (2015.10); *A63B 2209/00* (2013.01)

(58) Field of Classification Search
CPC ..... A63B 71/143; A63B 71/14; A63B 71/141; A63B 2102/18; A63B 2069/0011; A63B 2102/182; A63B 2209/00; A41D 19/01; A41D 2600/10
USPC ..... 2/19, 161.1
See application file for complete search history.

(56) References Cited

U.S. PATENT DOCUMENTS 1,974,616 A * 9/1934 Kirkham ..... A63B 71/143 2/19
2,778,023 A * 1/1957 Tompkins ..... A63B 71/143 2/19
4,339,830 A * 7/1982 Sasaki ..... A63B 71/143 2/19
5,031,239 A * 7/1991 Panichello ..... A63B 71/143 2/19
5,572,739 A * 11/1996 Kolada ..... A63B 71/143 2/161.1

* cited by examiner

*Primary Examiner* — Nathan E Durham
*Assistant Examiner* — Abby M Spatz
(74) *Attorney, Agent, or Firm* — Ashkan Najafi

(57) ABSTRACT

A short stop baseball mitt includes a cone-shaped body having a palm area provided with a first baseball-receiving section having an elastic and resilient circular indentation located at the anterior surface and spaced from the posterior surface, and configured to provide ball catching control, a thumb-receiving region located at the first lateral side and engaged with the posterior surface, an index finger-receiving region spaced from the thumb-receiving region and located only at the posterior surface thereby being spaced from the anterior surface, and a second baseball-receiving section including an elastic and resilient padded pocket located only at the anterior surface thereby being spaced from the posterior surface. The elastic and resilient padded pocket is intercalated between the thumb-receiving region and the index finger-receiving region while disposed anteriorly of the index finger-receiving region.

12 Claims, 5 Drawing Sheets

SHORT-STOP BASEBALL MITT AND ASSOCIATED USE THEREOF

CROSS REFERENCE TO RELATED APPLICATIONS

This is a continuation-in-part application of non-provisional patent application Ser. No. 15/394,717, filed Dec. 29, 2016, currently pending, which claims the benefit of and priority to U.S. provisional patent application No. 62/272,640 filed Dec. 29, 2015, all of which are incorporated by reference herein in their entireties.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to baseball mitts and, more particularly, to a short stop baseball mitt including a padded circular indentation in the palm area of the glove, for better ball catching control, as well as a padded web area between the thumb and index finger wherein a user can achieve optimal control of hot ground balls that can come at speeds of up to 90 plus miles per hour.

Prior Art

Baseball is wonderful. Any day throughout the summer, one can walk down by the local park and witness kids and adults both enjoying this wonderful game. The game has penetrated the national psyche, with two different national conferences forming the major leagues, and many smaller leagues dedicated to everyone from children to retired folk. Some of our greatest heroes have been made out on the green diamond, and their achievements and accomplishments live on forever in the annals of our collective history.

Statistics, it could be said, are the bedrock upon which the grand hall of baseball is constructed. Our reverence for the star players of old is based upon sober reflection on the impressive numbers they managed to put up for entry in the history books. It's impossible to condense the entire enterprise down to one single statistical measure, as the game itself calls for the interaction of so many different and unique variables. The batting average is a common denominator that attempts to reduce the entire sport to a single equation capable of ranking the participants, but the team environment naturally inspires outliers who excel in all different, subtle niches of the endeavor, making the batting average but a predicated scratch at the surface.

Baseball is a great American pastime, and it is enjoyed every year by committed fans from around the globe. Many people are thrilled with the enjoyment of watching professional pitchers and batsmen perform, and enjoy sharing their obsession with others of a similar bent. Baseball itself is a thrilling and engaging game, a protracted contest of wit and skill that provides a vibrant team drama for adherents to engage with. The players that make up any team are the mainstay attraction; fans love to idolize different players and lionize them extensively, quoting the statistics of their achievements and touting their relative importance to the team's overall success.

Rating different players on a relative scale can be difficult, as each trains to excel in his or her specific niche of play. As a result, there's no hard and fast statistical measure by which each player's contribution can be readily ascertained and accounted. One particular position often overlooked is the shortstop. The shortstop is responsible for much of the defensive action in Baseball, and yet this important position is often neglected as a specific position in its own right, lost as it is somewhere between 2nd and 3rd base and the left outfield.

Accordingly, a need remains for a short stop baseball mitt in order to overcome at least one prior art shortcoming. The exemplary embodiment(s) satisfy such a need by providing a short stop baseball mitt including a padded circular indentation in the palm area of the glove, for better ball catching control, as well as a padded web area between the thumb and index finger that is convenient and easy to use, lightweight yet durable in design, versatile in its applications, and designed for achieving optimal control of hot ground balls that can come at speeds of up to 90 plus miles per hour.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a short stop baseball mitt for providing optimal control of hot ground balls arriving at speeds of approximately 90 miles per hour. These and other objects, features, and advantages of the non-limiting exemplary embodiment(s) are provided by a short stop baseball mitt including a cone-shaped body including an anterior surface and a posterior surface oppositely facing therefrom, a first lateral side and a second lateral side oppositely disposed therefrom, a palm area located between the first lateral side and the second lateral side wherein the palm area includes a first baseball-receiving section having an elastic and resilient circular indentation located at the anterior surface and spaced from the posterior surface, and configured to provide ball catching control.

In a non-limiting exemplary embodiment, the body further includes a thumb-receiving region located at the first lateral side and engaged with the posterior surface, an index finger-receiving region spaced from the thumb-receiving region and located only at the posterior surface thereby being spaced from the anterior surface, and a second baseball-receiving section including an elastic and resilient padded pocket located only at the anterior surface thereby being spaced from the posterior surface. A middle finger-receiving region is extended from the anterior surface to the posterior surface and spaced from the thumb-receiving region. Advantageously, an elastic and resilient padded pocket being intercalated between the thumb-receiving region and the middle finger-receiving region and further being spaced anteriorly of the index finger-receiving region such that a gap is located between the elastic and resilient padded pocket and the index-receiving region. In this manner, the first baseball-receiving section and the second baseball-receiving section collectively are disposed along a major surface area of the anterior surface and configured to control ground balls arriving at speeds up to 90 plus miles per hour.

In a non-limiting exemplary embodiment, each of the elastic and resilient circular indentation and the elastic and resilient padded pocket includes a threaded mesh fabric including nylon webbing.

In a non-limiting exemplary embodiment, the body further includes a top edge region extending from the first lateral side to the second lateral side, a middle region contiguous with the top edge region and extending downwardly therefrom, and a bottom edge region contiguous with the middle region and extending downwardly therefrom.

In a non-limiting exemplary embodiment, the anterior surface is stitched to the posterior surface along the top edge region and the bottom edge region.

In a non-limiting exemplary embodiment, the nylon webbing at the elastic and resilient circular indentation includes a diameter equal to approximately 3.0 inches, and a depth equal to approximately 0.25-0.50 inches deep measured posteriorly from an outermost plane of the anterior surface.

In a non-limiting exemplary embodiment, the elastic and resilient padded pocket is contiguous with the top edge region.

In a non-limiting exemplary embodiment, the index finger-receiving region is disposed at the posterior surface and spaced from the anterior surface as well as the elastic and resilient padded pocket.

In a non-limiting exemplary embodiment, the thumb-receiving region is intercalated between the anterior surface and the posterior surface.

In a non-limiting exemplary embodiment, the body further includes a ring-finger receiving region, and a pinky-finger receiving region each extended from the anterior surface to the posterior surface and being mutually exclusive of each other.

In a non-limiting exemplary embodiment, the body further includes an elastic and resilient strap located adjacent to the bottom edge region.

In a non-limiting exemplary embodiment, the nylon webbing at the elastic and resilient padded pocket includes a top region having latitudinal length equal to approximately 4.0 inches, a middle region having a latitudinal length equal to approximately 3.0 inches, and a bottom region having a latitudinal length equal to approximately 2.0 inches.

In a non-limiting exemplary embodiment, the cone shaped body includes a longitudinal length between the top edge region and the bottom edge region equal to approximately 10 inches, a latitudinal length of the top edge region equal to approximately 8 inches, a latitudinal length of the middle region equal to approximately 6 inches, and a latitudinal length of the bottom edge region equal to approximately 3.5 inches.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
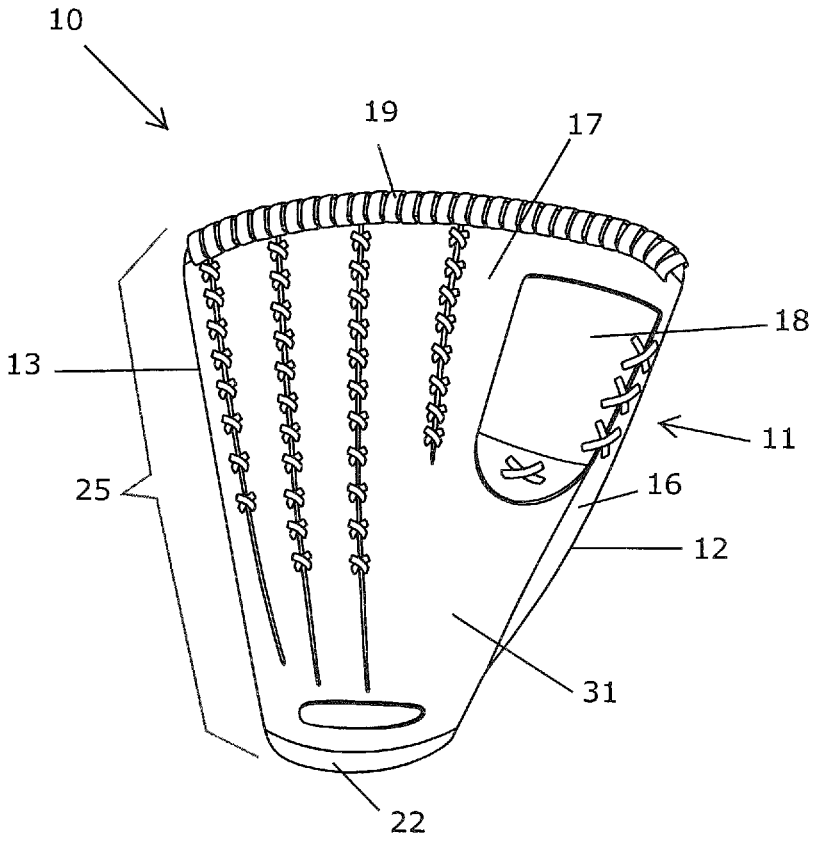
FIG. 1 is a perspective view of a posterior side of a short stop baseball mitt, in accordance with a non-limiting exemplary embodiment.

Those skilled in the art will appreciate that the figures are not intended to be drawn to any particular scale; nor are the figures intended to illustrate every non-limiting exemplary embodiment(s) of the present disclosure. However, there are specific dimensions for certain portions of the non-limiting exemplary embodiment(s), which are important to intended function and purpose of the claimed subject matter.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive. It is noted that specific dimensions listed herein are important to the intended function and purpose of the claimed subject matter.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, base, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
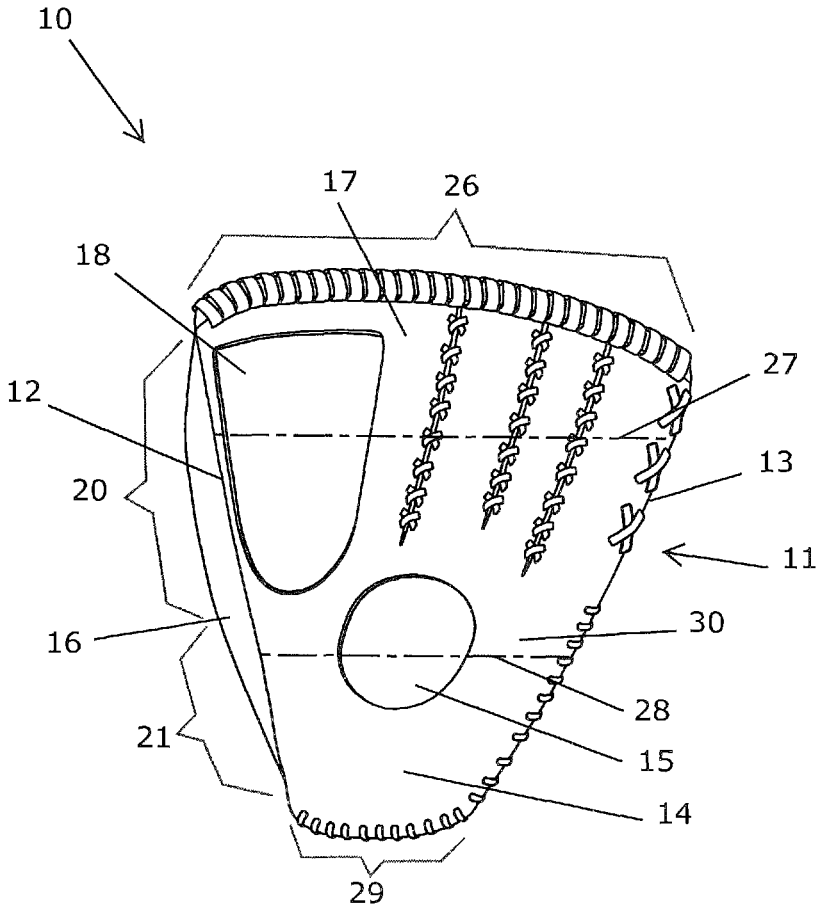
FIG. 2 is a perspective view of an anterior side of the short stop baseball mitt shown in FIG. 1.
Figure 3:
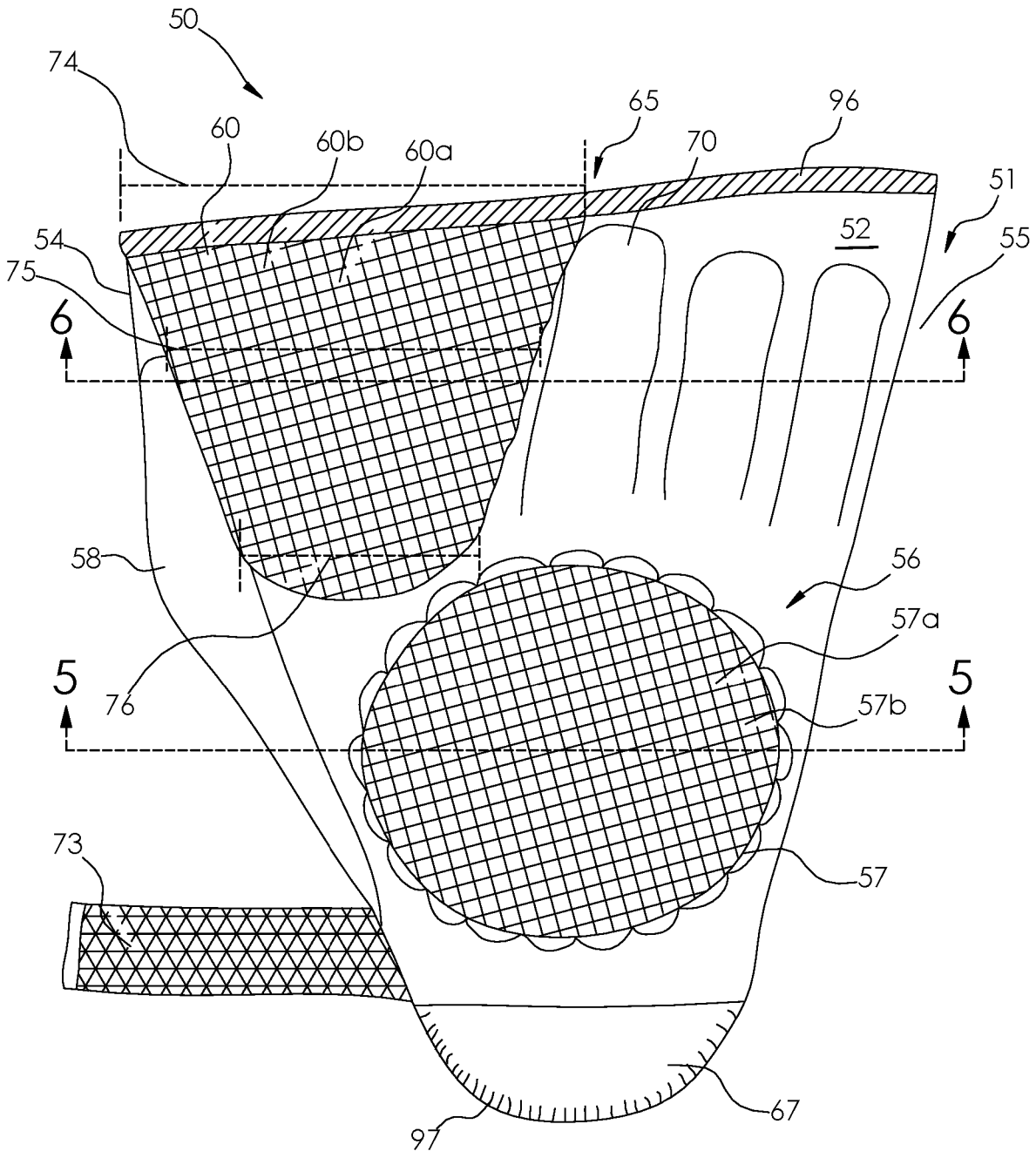
FIG. 3 is a top plan view of an anterior side of a short stop baseball mitt, in accordance with another non-limiting exemplary embodiment.
Figure 4:
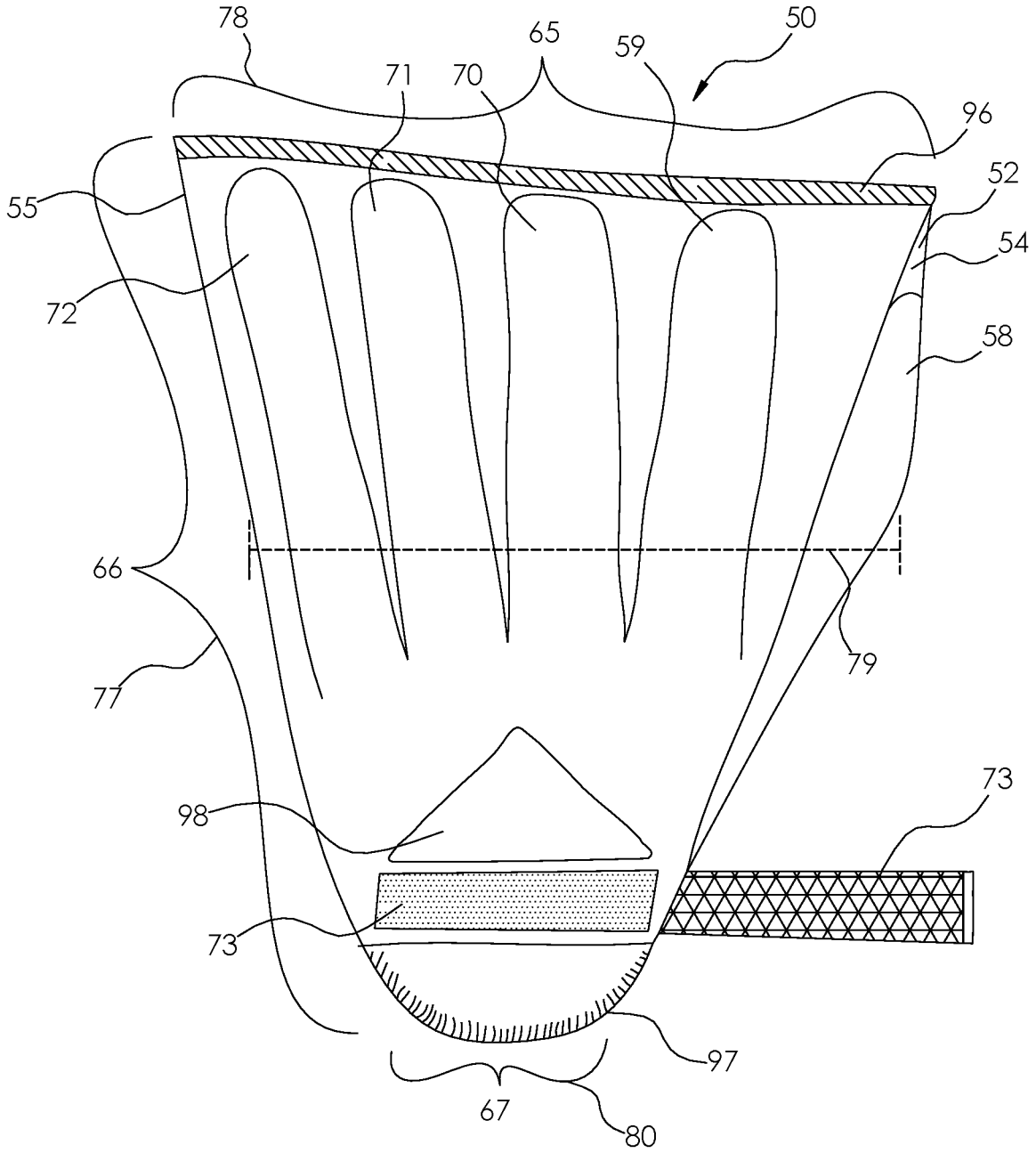
FIG. 4 is a bottom plan view of a posterior side of the short stop baseball mitt shown in FIG. 3.
Figure 5:
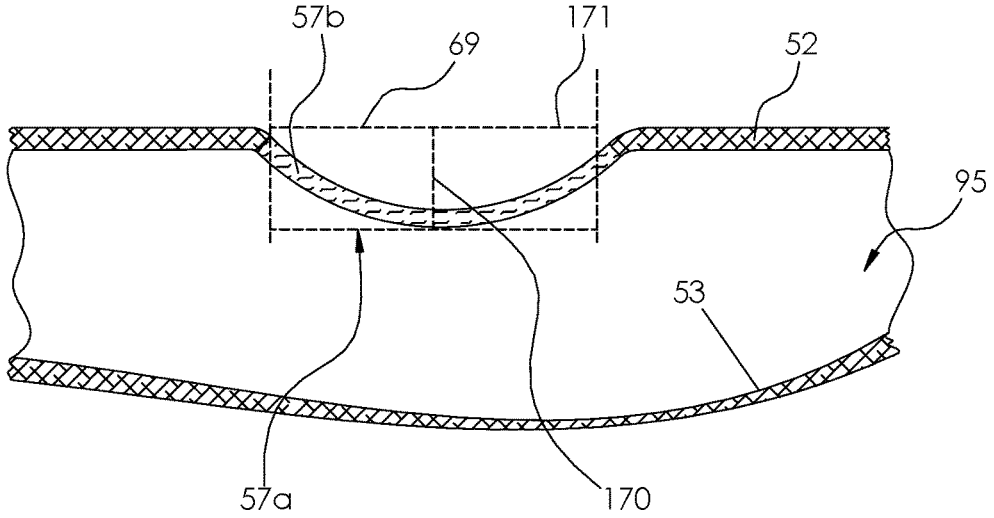
FIG. 5 is a cross-sectional view taken along line 5-5 in FIG. 3, showing the indentation of the padded pocket formed in the anterior surface.
Figure 6:
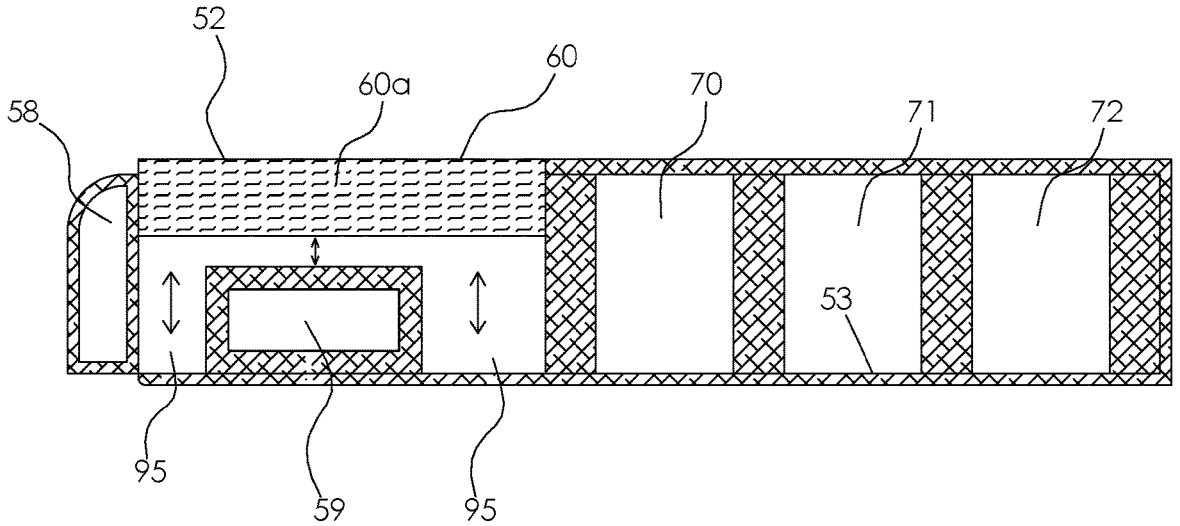
FIG. 6 is a cross-sectional view taken along line 6-6 in FIG. 3, showing the index finger-receiving region located at the posterior surface and spaced from the anterior facing mesh padded pocket.

The non-limiting exemplary embodiment(s) of the present disclosure is referred to generally in FIGS. 1-2 and is intended to provide a short stop baseball mitt 10 including a padded circular indentation (hole 15) in the palm area 14 of the glove, for better ball catching control, as well as a padded web area (elastic pocket 18) between the thumb and index finger regions 16, 17 wherein a user can achieve optimal control of hot ground balls that can come at speeds of up to 90 plus miles per hour. It should be understood that the exemplary embodiment may be used by a variety of age groups, and should not be limited to any particular age group described herein.

Referring to FIGS. 1-2, the short stop baseball mitt 10 includes a body 11 having a first lateral side 12 and a second lateral side 13 oppositely disposed therefrom, and a palm area 14 located between the first lateral side 12 and the second lateral side 13. Such a palm area 14 has a hole 15 capable of providing better ball catching control. The mitt 10 further includes a thumb-receiving region 16 located adjacent to the first lateral side 12, an index finger-receiving region 17 spaced from the thumb-receiving region 16 and located medially between the first lateral side 12 and the second lateral side 13, and an elastic padded web pocket 18 intercalated between the thumb-receiving region 16 and the index finger-receiving region 17.

In a non-limiting exemplary embodiment, the body 11 further includes a top edge region 19 extending from the first lateral side 12 to the second lateral side 13, a middle region 20 contiguous with the top edge region 19 and extending downwardly therefrom, a lower region 21 contiguous with the middle region 20 and extending downwardly therefrom, and a bottom edge region 22 contiguous with the lower region 21 and extending downwardly therefrom.

In a non-limiting exemplary embodiment, a longitudinal length 25 between the top edge region 19 and the bottom edge region 22 is approximately 10 inches.

In a non-limiting exemplary embodiment, the top edge region 19 has a latitudinal length 26 of approximately 8 inches.

In a non-limiting exemplary embodiment, the middle region 20 has a latitudinal length 27 between approximately 7.0 to 7.5 inches.

In a non-limiting exemplary embodiment, the lower region 21 has a latitudinal length 28 between approximately 5.0 to 5.5 inches.

In a non-limiting exemplary embodiment, the bottom edge region 22 has a latitudinal length 29 of approximately 4.5 inches.

In a non-limiting exemplary embodiment, the body 11 further includes an anterior surface 30 and a posterior surface 31 opposed therefrom. Such a hole 15 is located at the anterior surface 30. Notably, the hole 15 has a depth, extended from the anterior surface 30 to the posterior surface 31, between approximately 0.25 to 0.50 inches.

It is noted that the dimensions of the structure listed hereinabove are critical and necessary for ensuring the claimed subject matter properly performs its intended function. Such a combination of dimensions provide the unexpected and unpredictable advantage of fielding fast-pasted balls during short stop play at the infield.

The present disclosure further includes a method of utilizing a short stop baseball mitt 10 for providing optimal control of hot ground balls arriving at speeds of up to 90 plus miles per hour. Such a method includes the steps of: providing a body 11 by performing the sub-steps of: providing a first lateral side 12 and a second lateral side 13 oppositely disposed therefrom; providing and locating a palm area 14 between the first lateral side 12 and the second lateral side 13 wherein the palm area 14 has a hole 15 capable of providing better ball catching control; providing and locating a thumb-receiving region 16 adjacent to the first lateral side 12; providing and spacing an index finger-receiving region 17 from the thumb-receiving region 16; locating the index finger-receiving region 17 medially between the first lateral side 12 and the second lateral side 13; and providing and intercalating an elastic padded web pocket 18 between the thumb-receiving region 16 and the index finger-receiving region 17.

Referring to FIGS. 3-6, in a non-limiting exemplary embodiment, a short stop baseball mitt 50 includes a cone-shaped body 51 having an anterior surface 52 and a posterior surface 53 oppositely facing therefrom, a first lateral side 54 and a second lateral side 55 oppositely disposed therefrom, and a palm area 56 located between the first lateral side 54 and the second lateral side 55. Advantageously, the palm area 56 includes a first baseball-receiving section 57 having an elastic and resilient circular indentation **57*a* located at the anterior surface 52 and spaced from the posterior surface 53**, and configured to provide ball catching control. Such a structural configuration provides the new, useful, and unexpected benefit of effectively catching and re-throwing high velocity balls, allowing the wearer to both intercept low-flying high-velocity balls and redirect them to the appropriate infield location.

In a non-limiting exemplary embodiment, the body 51 further includes a thumb-receiving region 58 located at the first lateral side 54 and engaged with the posterior surface 53, an index finger-receiving region 59 spaced from the thumb-receiving region 58 and located only at the posterior surface 53 thereby being spaced from the anterior surface 52, and a second baseball-receiving section 60 including an elastic and resilient padded pocket 60*a* located only at the anterior surface 52 thereby being spaced from the posterior surface 53. Advantageously, a middle finger-receiving region 70 is extended from the anterior surface 52 to the posterior surface 53 and spaced from the thumb-receiving region 58. Advantageously, the elastic and resilient padded pocket 60*a* is intercalated between the thumb-receiving region 58 and the middle finger-receiving region 70 and further is spaced anteriorly of the index finger-receiving region 59 such that a gap 95 is located between and partially about the elastic and resilient padded pocket 60*a* and the index finger-receiving region 59. Such a structural configuration provides the new, useful, and unexpected benefit of enabling the elastic and resilient padded pocket 60*a* to adequately stretch and contract, when catching high-velocity balls, without exerting an impact force on the index finger-receiving region 59 and risking injury to the user's thumb, index finger, and middle finger. In this manner, the first baseball-receiving section 57 and the second baseball-receiving section 60 collectively are disposed along a major surface area of the anterior surface 52 and configured to control ground balls arriving at speeds up to 90 plus miles per hour. Such a structural configuration provides the new, useful, and unexpected benefit of effectively catching and re-throwing high velocity balls, allowing the wearer to both intercept low-flying high-velocity balls and redirect them to the appropriate infield location.

In a non-limiting exemplary embodiment, each of the elastic and resilient circular indentation 57*a* and the elastic and resilient padded pocket 60*a* includes a threaded mesh fabric including nylon webbing 57*b*, 60*b*. Such a structural configuration provides the new, useful, and unexpected benefit of enabling a firmer grip of high-velocity balls without stinging the user's index finger and thumb.

In a non-limiting exemplary embodiment, the body 51 further includes a top edge region 65 extending from the first lateral side 54 to the second lateral side 55, a middle region 66 contiguous with the top edge region 65 and extending downwardly therefrom, and a bottom edge region 67 contiguous with the middle region 66 and extending downwardly therefrom.

In a non-limiting exemplary embodiment, the anterior surface 52 is stitched 96, 97 to the posterior surface 53 along the top edge region 65 and the bottom edge region 67. Such a structural configuration provides the new, useful, and unexpected benefit of ensuring the user maintains adequate control of the first and second baseball-receiving sections 57, 60.

In a non-limiting exemplary embodiment, the nylon webbing 57*b* at the elastic and resilient circular indentation 57*a* includes a diameter 69 equal to approximately 3.0 inches, and a depth 170 equal to approximately 0.25-0.50 inches deep measured posteriorly from an outermost plane 171 of the anterior surface 52. Such a structural configuration provides the new, useful, and unexpected benefit of adequately receiving and maintain the baseball at a palm-central position for quick retrieval and throw.

In a non-limiting exemplary embodiment, the elastic and resilient padded pocket 60*a* is contiguous with the top edge region 65. Such a structural configuration provides the new, useful, and unexpected benefit of ensuring the high-velocity baseball does not bounce off or skip off the top edge region 65 of the mitt 50.

In a non-limiting exemplary embodiment, the index finger-receiving region 59 is disposed at the posterior surface 53 and spaced from the anterior surface 52 as well as the elastic and resilient padded pocket 60*a*. Such a structural configuration provides the new, useful, and unexpected benefit of shielding the user's index finger and preventing undesirably manipulation of the second baseball-receiving section 60 as the user flexes the index finger.

In a non-limiting exemplary embodiment, the thumb-receiving region 58 is intercalated between the anterior surface 52 and the posterior surface 53. Such a structural configuration provides the new, useful, and unexpected benefit of facilitating independent contraction and expansion of the second baseball-receiving section 60 by merely manipulating the thumb.

In a non-limiting exemplary embodiment, the body 51 further includes a ring finger-receiving region 71, and a pinky finger-receiving region 72 each extended from the anterior surface 52 to the posterior surface 53 and being mutually exclusive of each other. Such a structural configuration provides the new, useful, and unexpected benefit of enabling the user to flex and retract the body 51 as needed without affecting the first baseball-receiving section 57 and the second baseball-receiving section 60 during retrieval and throwing of the baseball.

In a non-limiting exemplary embodiment, the body 51 further includes an elastic and resilient strap 73 located adjacent to the bottom edge region 67. An opening 98 may be located adjacent to the strap 73 for circulating air inside the body 51. Such a structural configuration provides the new, useful, and unexpected benefit of tightening the mitt 50 to a desired tension without undesirably tensioning the first baseball-receiving section 57 and the second baseball-receiving section 60.

In a non-limiting exemplary embodiment, the nylon webbing 60*b* at the elastic and resilient padded pocket 60*a* includes a top region 74 having latitudinal length equal to approximately 4.0 inches, a middle region 75 having a latitudinal length equal to approximately 3.0 inches, and a bottom region 76 having a latitudinal length equal to approximately 2.0 inches. Such a structural configuration provides the new, useful, and unexpected benefit of effectively catching and re-throwing, allowing the user to both intercept low-flying balls and redirect them to the appropriate infield location.

In a non-limiting exemplary embodiment, the cone shaped body 51 includes a longitudinal length 77 between the top edge region 65 and the bottom edge region 67 equal to approximately 10 inches, a latitudinal length 78 of the top edge region 65 equal to approximately 8 inches, a latitudinal length 79 of the middle region 66 equal to approximately 6 inches, and a latitudinal length 80 of the bottom edge region 67 equal to approximately 3.5 inches. Such a structural configuration provides the new, useful, and unexpected benefit of catching and for re-throwing, allowing the wearer to both intercept low-flying balls and redirect them to the appropriate infield location to best advance one's own score while retarding the scoring ability of one's components It is noted that the dimensions of the structure listed hereinabove are critical and necessary for ensuring the claimed subject matter properly performs its intended function. Such a combination of dimensions provide the unexpected and unpredictable advantage of fielding fast-pasted balls during short stop play at the infield.

Referring to FIGS. 1-5, in a non-limiting exemplary embodiment, portions of the short stop baseball mitt 50 can be constructed from either natural leather or higher-performance synthetic materials such as threaded mesh fabric having a nylon webbing 57*b*, 60*b*. The material can be dyed or decorated as desired, allowing the short stop baseball mitt 50 to be effectively branded or otherwise coordinated with prevailing design aesthetics at the time of manufacture.

In a non-limiting exemplary embodiment, the fingers of the mitt 50 are flattened oblongs which extend up together, each stitched to the next in order to provide greater imperviability for the basket. The palm area 56 of the short stop baseball mitt 50 is hollowed out (indentation), allowing for a comfortable receiving of the baseball itself. Between the extended thumb and the index finger of the short stop baseball mitt 50, a weave of overlapping strands (elastic pocket) provides a suitable catchment area for high-speed projectiles.

Using the short stop baseball mitt 50 is relatively simple. In essence, the glove is used much as any other baseball glove—it is worn on the hand during game time, and used to protect the hand when catching high-speed incoming balls. The "V" shaped (cone-shaped) body 51 provides the added bonus of being designed both for catching and for re-throwing, allowing the wearer to both intercept low-flying balls and redirect them to the appropriate infield location to best advance one's own score while retarding the scoring ability of one's components. Much like any other baseball mitt 50, it requires little care beyond perhaps the occasional oiling to prevent the eventual degradation of the leather.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A short stop baseball mitt comprising: a cone-shaped body including an anterior surface and a posterior surface;

a first lateral side and a second lateral side oppositely disposed therefrom;

a palm area located between said first lateral side and said second lateral side, said palm area including a first baseball-receiving section having an elastic and resilient circular indentation located at said anterior surface and spaced from said posterior surface, and configured to provide ball catching control;

a thumb-receiving region located at said first lateral side and engaged with said posterior surface;

an index finger-receiving region spaced from said thumb-receiving region and located only at said posterior surface thereby being spaced from said anterior surface;

a middle finger-receiving region situated between said anterior surface and said posterior surface and spaced from said thumb-receiving region; and a second baseball-receiving section including an elastic and resilient padded pocket located only at said anterior surface thereby being spaced from said posterior surface, said elastic and resilient padded pocket being intercalated between said thumb-receiving region and said middle finger-receiving region and further being spaced anteriorly of said index finger-receiving region such that a gap is located between and partially about said elastic and resilient padded pocket and said index finger-receiving region;

wherein said first baseball-receiving section and said second baseball-receiving section collectively form a major surface area of only said anterior surface and are configured to control ground balls arriving at speeds up to 90 plus miles per hour.

2. The short stop baseball mitt of claim 1, wherein each of said elastic and resilient circular indentation and said elastic and resilient padded pocket comprises: a threaded mesh fabric including nylon webbing.

3. The short stop baseball mitt of claim 2, wherein said cone-shaped body further comprises:

a top edge region extending from said first lateral side to said second lateral side;

a middle region contiguous with said top edge region and extending downwardly therefrom; and a bottom edge region contiguous with said middle region and extending downwardly therefrom.

4. The short stop baseball mitt of claim 3, wherein said anterior surface is stitched to said posterior surface along said top edge region and said bottom edge region.

5. The short stop baseball mitt of claim 4, wherein said nylon webbing at said elastic and resilient circular indentation comprises:

a diameter equal to approximately 3.0 inches; and a depth equal to approximately 0.25-0.50 inches deep measured posteriorly from an outermost plane of said anterior surface.

6. The short stop baseball mitt of claim 5, wherein said elastic and resilient padded pocket is contiguous with said top edge region.

7. The short stop baseball mitt of claim 6, wherein said index finger-receiving region is disposed at said posterior surface and spaced from said anterior surface as well as said elastic and resilient padded pocket.

8. The short stop baseball mitt of claim 7, wherein said thumb-receiving region is intercalated between said anterior surface and said posterior surface.

9. The short stop baseball mitt of claim 8, further comprising: a ring-finger receiving region, and a pinky-finger receiving region each situated between said anterior surface and said posterior surface and being mutually exclusive of each other.

10. The short stop baseball mitt of claim 9, further comprising: an elastic and resilient strap located adjacent to said bottom edge region.

11. The short stop baseball mitt of claim 10, wherein said nylon webbing at said elastic and resilient padded pocket comprises:

a top region having latitudinal length equal to approximately 4.0 inches;

a middle region having a latitudinal length equal to approximately 3.0 inches; and a bottom region having a latitudinal length equal to approximately 2.0 inches.

12. The short stop baseball mitt of claim 11, wherein said cone shaped body comprises:

a longitudinal length between said top edge region and said bottom edge region equal to approximately 10 inches;

a latitudinal length of said top edge region equal to approximately 8 inches;

a latitudinal length of said middle region equal to approximately 6 inches; and a latitudinal length of said bottom edge region equal to approximately 3.5 inches.

* * * * *